United States Patent [19]

Vossen

[11] Patent Number: 4,574,999

[45] Date of Patent: Mar. 11, 1986

[54] CONTAINER

[75] Inventor: Franz Vossen, Radolfzell, Fed. Rep. of Germany

[73] Assignee: Meurer Nonfood Product GmbH, Radolfzell, Fed. Rep. of Germany

[21] Appl. No.: 446,977

[22] Filed: Dec. 6, 1982

[30] Foreign Application Priority Data

Dec. 15, 1981 [DE] Fed. Rep. of Germany ..... 3149645

[51] Int. Cl.[4] ..... B65D 5/20

[52] U.S. Cl. ..... 229/30; 229/49; 229/2.5 R; 220/74

[58] Field of Search ..... 220/74; 229/30, 49, 229/5.8, 5.6, 5.5, 2.5 R

[56] References Cited

U.S. PATENT DOCUMENTS

| | | | |
|---|---|---|---|
| 2,391,767 | 12/1945 | Beerend | 229/30 |
| 3,451,588 | 6/1969 | Weber | 220/74 |
| 4,026,458 | 5/1977 | Morris et al. | 229/30 |
| 4,113,095 | 9/1978 | Dietz et al. | 220/74 |
| 4,364,477 | 12/1982 | Stromberg | 220/74 |

FOREIGN PATENT DOCUMENTS

| | | | |
|---|---|---|---|
| 477952 | 10/1951 | Canada | 220/74 |
| 1292275 | 3/1962 | France | 220/74 |

*Primary Examiner*—Joseph Man-Fu Moy

*Attorney, Agent, or Firm*—Roberts, Spiecens & Cohen

[57] ABSTRACT

A container comprising a web or blank of material of limited flexibility with wall portions in which at least one edge is separated from a bent-over edge strip portion by a bend line, is provided with a maximum degree of stability so as to avoid any outward bulging and to resist the resilient forces tending to cause a return to an initial position. For that purpose, the bend line is interrupted by at least one geometrical surface portion serving as a stabilizing member which projects both into the edge strip portion and also into the wall portions, and which is separated from both by desired or predetermined bend lines. The blank can be made of cardboard with a coating of aluminum film or foil, for lining the interior of the container and the bend line is interrupted by at least one geometrical surface portion which projects into both portions of the blank, which are adjacent to the bend line, that is to say, the edge strip portion and the wall portion, and the stabilizing member is separated from the edge strip portion and the wall by bend lines which are at least partly cut. In both cases, at least the bend line is preferably produced by stamping or embossing, or by perforations.

12 Claims, 3 Drawing Figures

CONTAINER

BACKGROUND OF THE INVENTION

The present invention relates to a container comprising a blank of material of limited flexibility, in particular cardboard, having wall portions in which at least one edge is separated from a bent-over edge strip portion by a bend line.

Containers of that kind can be used in many areas in daily life, either as round containers such as buckets, yoghurt pots or the like, or in polygonal form, such as for example a square or rectangular baking pan or mould.

For many purposes, it has also been found to be a practical proposition for the containers to be put on the market, in the condition of being folded to form flat articles for despatch or mailing. Particularly known in this connection are folded baking pans or moulds, which are enclosed with the ready-to-use baking mix. When required, a housewife unfolds the baking pan, fills it with the baking mix and puts it in the oven.

Known containers of that kind have edge strip portions which project in a collar-like configuration from the upper edge of the wall of the containers, and which are intended inter alia to stabilize the wall of the container. However, under practical conditions of use of such containers, it has been found that, in spite of the edge strip portions provided thereon, the wall portions of the container bulge outwardly or lose their shape. That is attributed to the fact that, for example in the case of foldable containers which are made from a blank, the edge strip portions are not properly folded over and then do not remain in the necessary angular position of about 90° to the wall portions of the container, during use thereof. The tendency on the part of the edge strip portions, to return to their original position, is further promoted by the effect of heat for example in the case of a baking mould.

SUMMARY OF THE INVENTION

Since one of the essential functions of such a container is that it should retain a predetermined shape, the aim that the present inventor seeks to achieve is that of designing wall portions or edge strip portions comprising a material which is capable of a return motion and which is therefore of limited resiliency, in such a way as to achieve maximum stability, avoid any outward bulging effect, and resist the forces tending to cause the above-mentioned return motion.

That problem is solved in that the bend line is interrupted by at least one geometrical surface which projects both into the edge strip portion and into the wall portion, and is separated from both thereof by desired or predetermined bend lines.

That arrangement has the surprising effect that, once the edge strip portion has been bent out of the plane of the wall portion, the edge strip portion no longer returns, of its own accord, to its initial position. Likewise, it does not bend of its own accord through a further distance, to an angle of about 180°, which would also result in losing its stabilizing effect. It remains substantially at an angle of 90° to the wall portion, and thereby remains in its most effective position.

This invention serves to an even higher degree for stabilizing containers which must first be folded from a blank to constitute the ready-for-use condition of the container. A container which is selected by way of example herein is made from a cardboard blank having a coating of for example aluminum foil, for lining the interior of the container, as is used for example for a baking pan or mould.

However, the inventive concept does not cover for example only that embodiment or only containers, but instead the inventive concept can be applied whenever two surface portions which extend at an angle to each other are to provide a stabilization effect, either only in respect of those surface portions relative to each other, or in respect of an entire body or article. That means that the inventive concept, considered separately from containers or even baking pans or moulds, is to be considered solely as the feature that a bend line between two surfaces which are at an angle relative to each other is interrupted by at least one geometrical surface which projects both into one surface and into the other surface and which is separated from both by desired or predetermined bend lines.

The formation both of the bend line between the edge strip and the wall and also the predetermined or desired bend lines between the geometrical surface and the edge strip and wall can be effected by the same or different steps. It is easy for the bend line and/or the desired or predetermined bend lines to be produced by pressing or embossing. On the other hand, it has been found desirable for the bend line and the desired or predetermined bend lines to be perforated. Scratching or cutting of the bend line and/or the desired or predetermined bend line is also conceivable. In accordance with the invention however, as required, stamping or embossing, perforating and cutting or scratching may be combined or interchanged.

It is also possible for parts of the desired or predetermined bend line to be formed by punching, depending on the configuration of the respective geometrical figure. If for example the geometrical figure is in the form of a hexagon, the bend line between the wall and edge strip and the portions of the desired bend line of the hexagon which extend substantially parallel and displaced with respect thereto can be perforated, while the sides of the hexagon which extend from the desired bend lines towards the bend line can be punched out. This arrangement prevents the hexagonal surface from forming a dish-like dented configuration, as the two corners of the hexagon, which are on the bend line, are not subjected to a tensile loading.

If on the other hand the desired or predetermined bend lines surround a surface which is of a shape between the shape of an almond and an elliptical shape, and if they are only perforated, then they form a dished internal surface when the edge strip portion is bent over.

However, the geometrical surface may also be a circle or a polygon.

DESCRIPTION OF PREFERRED EMBODIMENTS

Figure 1:
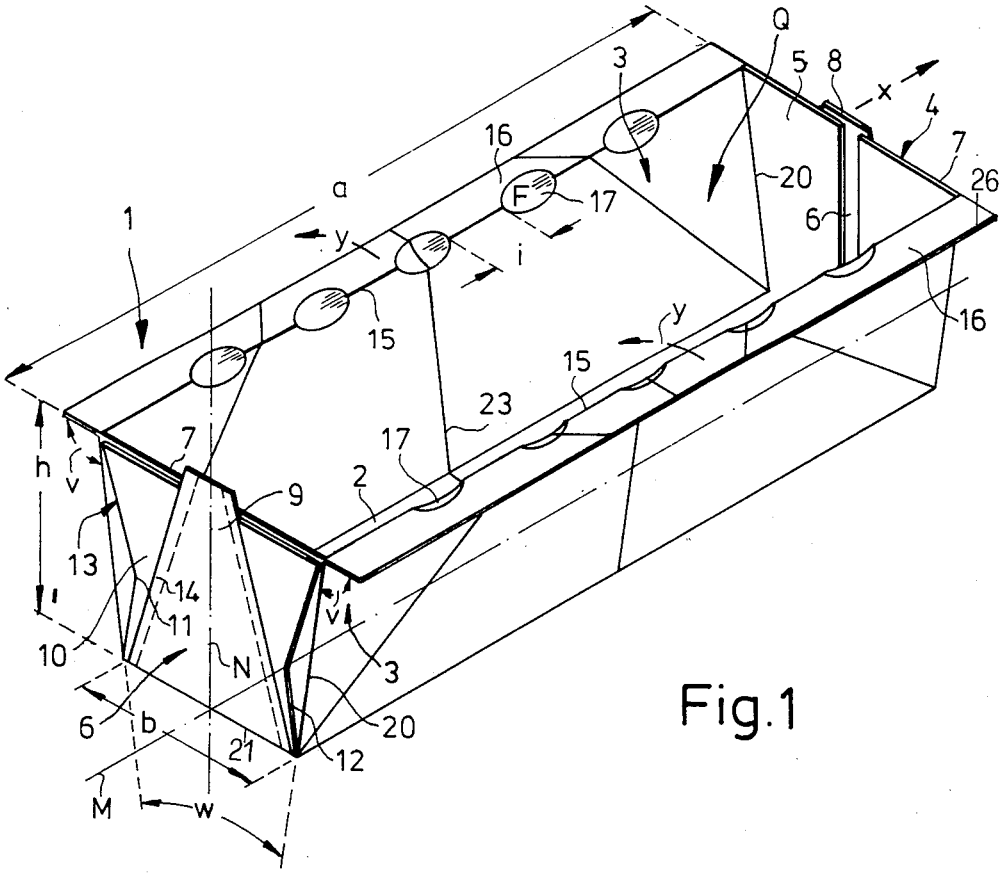
FIG. 1 is a perspective view of a baking pan or mould.

Further features, advantages and details of the invention will be apparent from the following description of preferred embodiments and with reference to the drawings in which:

A box-shaped, upwardly open baking pan or mould 1 which is for example 250 mm in length a comprises a bottom 2 which is 70 mm in width b, two side walls 3 which extend at an inclined angle w relative to each other and which are about 75 mm in height as indicated at h, and two end walls 4. The plane of symmetry of the baking mould 1 is defined by the longitudinal center line M of the baking mould 1 and the center line N, which is perpendicular thereto, of the end wall 4.

Each end wall 4 has two folding or flap strip portions 5, each of which is connected to a side wall 3 along a bend line 20. Associated with the strip portions 5 is a folding or flap tongue portion 6 which is connected to the bottom 2 along a bend line 21 and which projects beyond the top edge 7 of the end wall 4, to act as a gripping portion 8. The tongue portion 9 is composed of a central web portion 9 which tapers upwardly towards the gripping portion 8, and two wing or flank portions 10 which adjoin the central portion on both sides thereof. The side edge of each side portion 10 extends away from the bottom 2 in a lower edge section 12 substantially parallel to the edge of the central portion 9 and an outer desired or predetermined tear line 14, as far as a constriction from which an upper section 13 of the edge is directed outwardly towards the upper edge 15 of the side wall 3. A narrow edge strip portion 16 can be seen extending along the upper edge 15 of the side wall 3.

The upper edge 15 is in the form of a line of perforations separating the side wall 3 from the narrow edge strip portion 16, and is interrupted at spacings i by lines of perforations 17 of an elliptical configuration, which define an almond-shaped area or surface portion F of a stabilizing member. When the edge strip portion 16 is bent out of the plane of the side wall 3 through an angle v of about 90°, the area or surface portion F forms a dent of a dish-like configuration, and stabilizes the edge region of the article.

Figure 3:
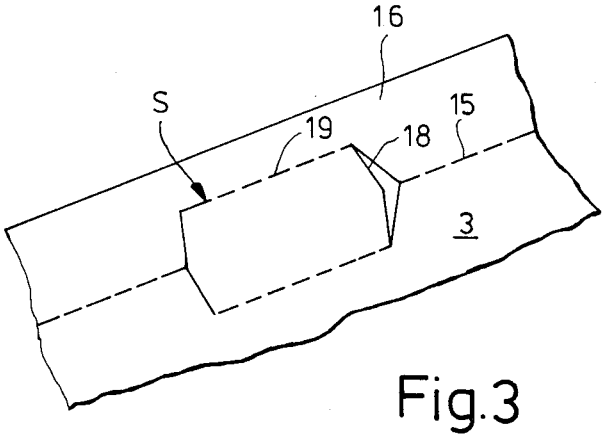
FIG. 3 is a perspective view of a further embodiment of a detail from FIG. 1, on an enlarged scale.

In another embodiment as shown in FIG. 3, the perforated line of the upper edge 15 is interrupted by a hexagonal area or surface portion S; the sides 18 thereof, which extend from the perforated line 15, are formed by punching, while the longitudinal lines 10 which extend parallel to the perforated line 15 are perforated. The hexagonal area or surface portion S remains substantially flat even when the edge strip portion 16 is bent out of the plane of the side wall.

All the above-described portions are jointly cut from a strip of material, preferably from a sheet of cardboard with a layer of aluminum foil or film applied thereto. The aluminum foil or film forms the contact layer for contact with the baking material (not shown), being directed towards the interior Q of the baking mould.

Figure 2:
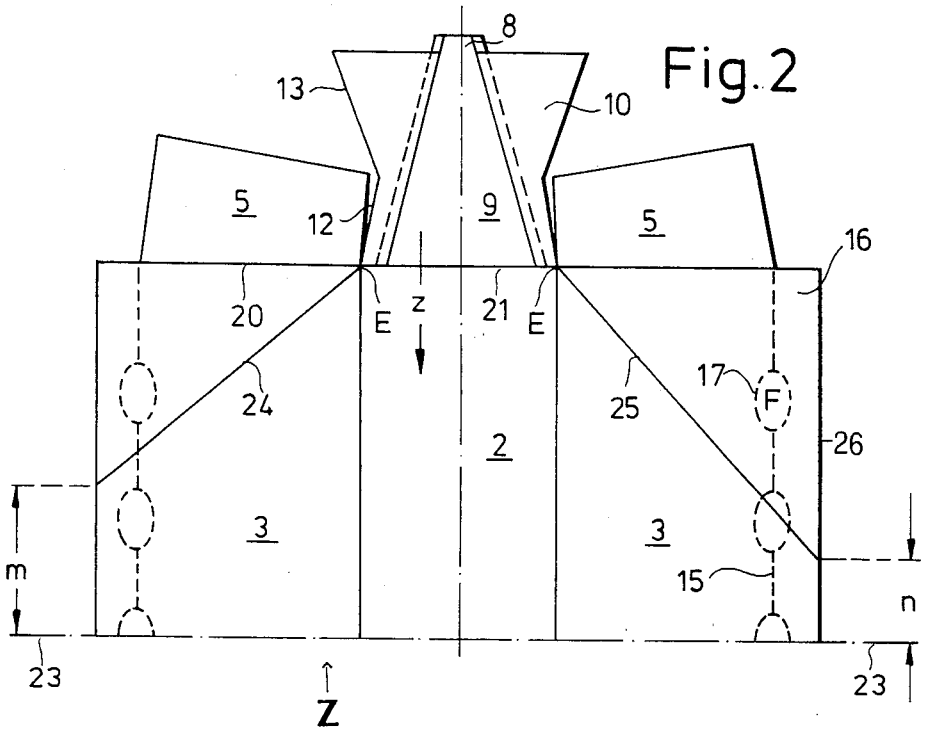
FIG. 2 is a plan view of half of the blank for making the baking mould.

FIG. 2 is a view of half of the blank Z for the baking mould 1, the half extending to a transverse fold line 23 forming a central line of symmetry. Besides the bend lines 15, 20 and 21 already described hereinbefore, the illustrated construction also comprises fold lines 24 and 25 which originate from the corners E of the baking mould 1 and which extend diagonally in the side walls 3 and the edge strip portions 16. The fold lines 24 and 25 terminate at the outer edge 26 of the edge strip portion 16 at different spacings m and n from the line of symmetry 23.

The bend lines 15, 20 and 21 serve to make the baking mould 1, while the fold lines 23 to 25 serve for folding it to form an article which is ready for despatch or mailing; the edge strip portion 16 is moved into the plane of the side wall 3 and the wall portions of the standing baking mould 1, which are defined by the diagonal fold lines 24 and 25 respectively, are bent in the direction y (see FIG. 1). The remaining parts of the side walls 3, with the end walls 4 secured thereto, are bent towards each other in the direction indicated by the arrow z (see FIG. 2). The two halves of the baking mould can then be laid one upon the other, being folded about the line of symmetry 23.

When the baking mould 1 is to be unfolded into its position for use, which is effected in the reverse sequence, the stability of the walls is achieved by folding the edge strip portions 16 outwardly through an angle of about 90° out of the plane of the side wall 3, in particular being promoted by the areas or surface portions F and S.

What is claimed is:

1. A baking pan comprising a blank of material of limited flexibility including a wall and an edge strip portion, said wall and edge strip portion initially being in coplanar arrangement in the plane of said blank, said edge strip portion being foldably connected to said wall along a bend line for bendable movement from its first position coplanar with said wall to a second position at an angle to said wall, and a plurality of stabilizing members disposed in spaced relation along said bend line and constituted by material partially in said wall and partially in said edge strip portion, said stabilizing members initially being in coplanar arrangement in the plane of the blank and having respective border lines by which said stabilizing members are connected to said wall and said edge strip portion, said border lines extending partly into said edge strip portion and partly into said wall such that when the edge strip portion is folded along said bend line said stabilizing members are deformed out of the planes of said wall and edge strip member to form recessed members to stabilize the pan at said bend line.

2. A baking pan as claimed in claim 1 wherein said bend line is interrupted by said stabilizing members.

3. A baking pan as claimed in claim 1 comprising a lining of metal foil on said blank for forming an internal lining for the folded pan.

4. A baking pan as claimed in claim 1 wherein said border lines of said stabilizing members with the wall and edge strip portion are at least partly cut.

5. A baking pan as claimed in claim 1 wherein said border lines and bend line are stamped or embossed.

6. A baking pan as claimed in claim 1 wherein said border lines and bend line include perforations.

7. A baking pan as claimed in claim 1 wherein the border line of each stabilzing member includes first line portions parallel to said bend line and second line portions joining said first line portions and extending at an angle to said bend line, said first line portions being bend lines and second line portions being slots.

8. A baking pan as claimed in claim 7 wherein the bend lines of said first line portions are respectively formed between the stabilizing member and the wall and between the stabilizing member and the edge strip portion.

9. A baking pan as claimed in claim 8 wherein said stabilizing members are of polygon shape.

10. A baking pan as claimed in claim 9 wherein said bend lines of said first line portions are formed by lines of perforations.

11. A baking pan as claimed in claim 1 wherein said stabilizing members are of elliptical shape.

12. A baking pan as claimed in claim 1 wherein said stabilizing members are of polygon shape.

* * * * *